United States Patent [19]

Nakanose et al.

[11] Patent Number: 4,726,857

[45] Date of Patent: Feb. 23, 1988

[54] JIG UNIT AND METHOD FOR HEAT TREATMENT OF VESSEL-LIKE WORKPIECE

[75] Inventors: Megumi Nakanose, Sagamihara; Yutaka Sohara, Tokyo, both of Japan

[73] Assignee: Nissan Motor Co., Ltd., Japan

[21] Appl. No.: 867,066

[22] Filed: May 27, 1986

[30] Foreign Application Priority Data

May 31, 1985 [JP] Japan ..... 60-119467

[51] Int. Cl.[4] ..... C21D 1/18

[52] U.S. Cl. ..... 148/143; 148/153; 266/274

[58] Field of Search ..... 266/249, 274, 287, 252, 266/258, 259; 148/143, 153, 149, 144; 72/342

[56] References Cited

U.S. PATENT DOCUMENTS

| | | | |
|---|---|---|---|
| 2,334,439 | 11/1943 | Pierce | 266/249 |
| 3,315,513 | 4/1967 | Ellenburg | 72/342 |
| 3,977,914 | 8/1976 | Wallner et al. | 148/143 |
| 4,602,767 | 7/1986 | Spiegelman et al. | 266/249 |

FOREIGN PATENT DOCUMENTS 1405205 9/1975 United Kingdom .

*Primary Examiner*—L. Dewayne Rutledge
*Assistant Examiner*—S. Kastler
*Attorney, Agent, or Firm*—Leydig, Voit & Mayer

[57] ABSTRACT

Disclosed in a jig unit for heat treatment of a metal workpiece such as, e.g., a hollow hemispherical work as a part of a rocket motor case. The jig unit includes a constraining templet member which is made of a metal having a greater coefficient of expansion than the material of the work and has an outer surface shaped correspondingly to the inner surface of the workpiece. A base of the jig unit holds the templet member and the workpiece such that the outer surface of the templet member is slightly spaced from the inner surface of the workpiece. The work is heated together with the templet member while introducing an inactive gas into the gap between the workpiece and the templet member. By thermal expansion the templet member comes into close contact with the inner surface of the workpiece and serves as a constraining means, whereby strains in the work are remedied. Cooling of the heated workpiece is carried out while the templet member is still in close contact with the inner surface of the workpiece.

7 Claims, 3 Drawing Figures

JIG UNIT AND METHOD FOR HEAT TREATMENT OF VESSEL-LIKE WORKPIECE

BACKGROUND OF THE INVENTION

This invention relates to a jig unit for heat treatment of a vessel-like workpiece having an inner concave surface such as, for example, a hollow hemispherical part of a rocket motor case and a heat treatment method using the same jig unit.

In heat treatment of vessel-like metal workpieces which are relatively large in size and relatively small in wall thickness, special car should be taken to prevent or minimize defects such as soft spots and quenching strainings. Examples of vessel-like workpieces having inner concave surfaces of concern include hollow cylindrical, conical or hemispherical sections of solid fuel rocket motor cases. Greater care is needed when quenching the heated vessel-like workpieces, because the cooling of a workpiece may be locally delayed in a region remote from the open end of the workpiece by the influence of hot air as well as, a vapor that originates from the cooling liquid which vapor is confined in the interior of the vessel-like workpiece. This is particularly important in the case of a hollow conical or hemispherical workpiece which must be held with its top or polar region upward during the heating and cooling operations.

A known support unit for heat treatment of, for example, a hollow hemispherical workpiece is comprised of an annular bed on which the work is placed its open end down and an exhaust duct having an end section which stands in the center of the annular bed to discharge gases from the interior of the hemispherical workpiece. The support unit is transferrable. After fastening the workpiece to the annular bed the support unit is placed in a furnace for heating the workpiece. After completion of the heating operation the support unit holding the heated workpiece is immersed in a cooling liquid. At this stage the exhaust duct serves the purpose of discharging air and the vapor of the cooling liquid from the interior of the hollow workpiece. By using such a support unit it is possible to decrease defects such as soft spots and quenching strains and accomplish almost uniform heat treatment of the hollow hemispherical workpiece since discharging air and vapor from the interior of the workpiece is effective for preventing delayed cooling of the closed end region of the workpiece.

However, still there are some problems. First, embrittled layers represented by oxide layers are formed on both the outer and inner surfaces of the vessel-like workpiece since the both surfaces are exposed to the heating atmosphere in the furnace for heat treatment. Removal of such embrittled layers, and particularly of the one on the inner surface of the vessel-like workpiece is a troublesome operation. Furthermore, quenching strains are liable to be produced in the major region of the vessel-like work, especially when the work is a large-sized one, since the work is heated and cooled in an unconstrained state except in its open end region clamped to the annular bed of the support unit. Therefore, the initial wall thickness of the work needs to be large enough for removal of the embrittled and strained layers by machining after the heat treatment. Then a large amount of grinding and/or milling is required for finishing the heat-treated work into a defectless and accurately sized part. Consequently the material and labor costs become considerably high.

SUMMARY OF THE INVENTION

It is an object of the present invention to provide a jig unit which can be used in the heat treatment of a vessel-like metal workpiece with little defects such as soft spots or quenching strains and without oxidizing or otherwise embrittling at least the inner surface of the vessel-like workpiece.

It is another object of the invention to provide a method for the heat treatment of a vessel-like metal workpiece by using a jig unit according to the invention.

A jig unit according to the invention for heat treatment of a vessel-like metal workpiece comprises a transferrable support means for holding the vessel-like workpiece in a region close to the open end, and a constraining templet member having an outer surface shaped correspondinly to the inner surface of the vessel-like workpiece. The material of the templet member has an expansion coefficient greater than the expansion coefficient of the material of the vessel-like workpiece, and the templet member is attached to the support means such that the outer surface of the templet member is slightly spaced from the inner surface of the vessel-like workpiece and comses into close contact with the inner surface of the work when the work and the templet member are heated together to a predetermined temperature. The jig unit further comprises a gas feed means to introduce an inactive gas into the space between the inner surface of the vessel-like workpiece and the outer surface of the templet member.

Preferably the support means of the jig unit is designed so as to hold the vessel-like workpiece in such a way that its open end faces down, and in such a case the jig unit includes an exhaust duct to discharge air and vapor from the interior of the vessel-like workpiece when cooling the heated workpiece together with the templet member.

During the heat treatment method according to the invention, the vessel-like workpiece is held by the aforementioned support means to which the constraining templet member is attached in the above stated manner, while an inactive gas is introduced into the space between the workpiece and the templet member. Because of the aforementioned difference of the expansion coefficients, heating of the workpiece and the templet member to the predetermined temperature results in close contact of the outer surface of the templet member with the inner surface of the workpiece, so that the workpiece is constrained by the templet member for the remaining period of the heating operation. After completion of the heating operation the workpiece is cooled to a predetermined temperature together with the templet member while the outer surface of the templet member is still in contact with the inner surface of the workpiece.

Preferably the templet member is designed such that, when the heated workpiece and templet member are cooled together, the templet member is lower in the rate of cooling than the workpiece. Also it is preferred to provide a layer of a cooling promoting material, which is higher in heat conductivity than the material of the templet member, on the outer surface of the templet member to thereby promote cooling of the vessel-like workpiece after the heating operation.

A primary advantage of the present invention resides in that strains produced in the vessel-like workpiece undergoing heat treatment are remedied by the action of the moderately expansionary force attributed to the thermal expansion of the constraining templet member in close contact with the inner surface of the workpiece. Therefore, it is possible to extremely decrease quenching strains in the heat-treated workpiece. Furthermore, oxidation or embrittlement of the inner surface of the workpiece is effectively prevented since the inner surface is shielded from the atmosphere during the heating operation. Therefore, the inner surface of the heat-treated workpiece retains luster. For these reasons, dimensional changes of the vessel-like workpiece by heat treatment are remarkably decreased, and machining operations necessary after heat treatment are lessened and lightened. Therefore, it is possible to reduce the initial wall thickness of the vessel-like workpieces even when high precision is required of the workpieces as in the cases of parts of rocket motor chambers. Consequently the material and labor costs can be considerably reduced by using the jig unit and heat treatment method according to the invention.

As will readily be understood, it is optional to shield and constrain the vessel-like workpiece not only on its inner side but also on its outer side. That is, a jig unit according to the invention may include another templet member which has an inner surface shaped correspondinly to the outer surface of the vessel-like workpiece and is made of a different material having an expansion coefficient smaller than the expansion coefficient of the material of the workpiece.

DESCRIPTION OF THE PREFERRED EMBODIMENTS

Figure 1:
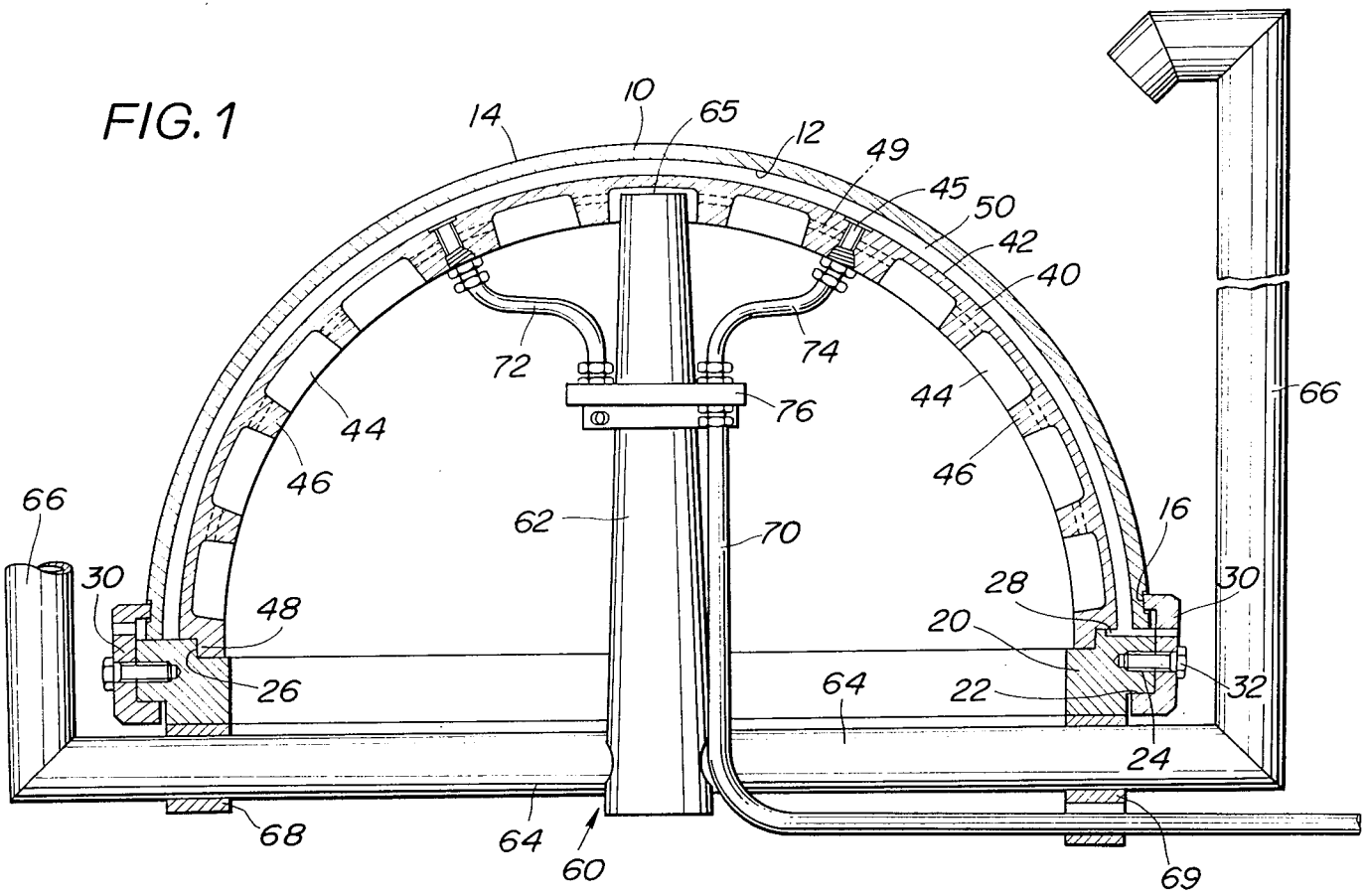
FIG. 1 is a vertical sectional view of a jig unit according to the invention for heat treatment of a hollow hemispherical workpiece.

As an embodiment of the present invention, FIG. 1 shows a jig unit for the heat treatment of a generally hemispherical and hollow metal workpieces 10, which is assumed to be a part of a rocket motor case.

Essentially the jig unit consists of an annular base 20 on which the workpieces 10 is placed, a hemispherical and hollow metal templet 40 which is attached to the base 20 and has an outer surface 42 shaped correspondingly to the hemispherical inner surface 12 of the workpieces 10, an exhaust duct 60 which has an inlet opening 65 located near the polar region of the hemispherical templet 40, and a gas feed pipe 70 to introduce an inactive gas into a narrow space 50 between the outer surface 42 of the templet 40 and the inner surface 12 of the workpieces 10.

The annular base 20 is nearly equal in outer diameter to the hemispherical workpieces 10 and is transferrable. On the radially outer side, the annular base 20 is formed with a plurality of shoulders 22 at suitable intervals, and there is a tap hole 24 just above each shoulder 22. In the outer surface 14 of the workpieces 10 a circumferential groove 16 is formed in the region close to the open end, and the workpieces 10 is fastened to the annular base 20 by a plurality of clamp plates 30 each of which is coupled with one of the shoulders 22 of the base 20 and also with the groove 16 of the workpieces 10 and is fixed to the base 20 by screwing a bolt 32 into the tap hole 24.

The hemispherical templet 40 has an outer diameter slightly smaller than the inner diameter of the hemispherical workpiece 10. The material of this templet 40 must have a greater coefficient of expansion than the material of the workpiece 10. For example, when the workpiece 10 is formed of a titanium alloy having a linear expansion coefficient of about $9.7\times10^{-6}/°$ C., an austenite stainless steel having a linear expansion coefficient of about $18.0\times10^{-6}/°$ C. can be used as the material of the templet 40. The templet 40 is attached to the annular base 20 by using a circumferential shoulder 26 on the upper side of the base 20 and a circumferential shoulder 48 of the templet 40. The radially inner side the hemispherical templet 40 is fomred with a number of grooves 44 so as to leave a number of reinforcing rib-like projections 46. The grooves 44 serve the purpose of enhancing the rate of cooling of the workpiece 10 after its heating together with the templet 40. Using a few of the rib-like projections 46, the templet 40 is formed with through-holes 45 for guiding the aforementioned inactive gas into the space 50 between the templet 40 and the work 10. Besides, the templet 40 is formed with gas passages 49 which communicate with gas discharge passages 28 in the base 20 and through which the inactive gas is discharged. The templet 40 has a sufficiently large mass so that the work 10 may be cooled more rapidly than the templet 40 at the cooling stage of the heat treatment.

The exhaust duct 60 has a central vertical section 62 which stands in the center of the hemispherical and hollow templet 40. The exhaust duct also includes horizontal sections postioned 64 transverse of the annular base 20 and external vertical sections 66. At the horizontal sections 64 the duct 60 is supported by bracket 68 and 69 fixed to the base 20.

The gas feed pipe 70 is supported by the bracket 69 and extends to a junction device 76 which is fastened to the central vertical section 62 of the exhaust duct 60. In this device 76 the pipe branches into a plurality of conduits 72, 74 which extend to and connect with the aforementioned through-holes 45 in the templet 40, respectively.

Using the above described jig unit heat treatment of the workpiece 10 is carried out in the following manner. The type of the heat treatment is not limited. For example, solution heat treatment and aging treatment may be made at usual temperatures and for usual periods.

First, a suitable ceramic powder such as boron nitride powder is applied, as a diffusion bonding inhibiter, to the outer surface 42 of the metal templet 40. Then the hollow hemispherical workpiece 10 is placed on the annular base 20 so as to coaxially enclose the hemispherical templet 40 and is fixed to the base 20 by using the clamp plates 30 and bolts 32. In that state the jig unit supporting the workpiece 10 is transferred into a furnace (not shown) for heat treatment. Then an inert gas such as argon is introduced into the narrow space or clearance 50 between the workpiece 10 and the outer surface 42 of the templet 40 through the pipe 70. Continuing the feed of the inert gas, the workpiece 10 on the base 20 in the furnace is heated up to a predetermined temperature (e.g. 800° C.) and kept at that temperature for a predetermined period of time. Naturally the templet 40 too is heated to the same temperature. Since the expansion coefficient of the templet 40 is greater than that of the workpiece 10, thermal expansion of the templet 40 results in close and compressive contact of the outer surface 42 of the templet 40 with the inner surface 12 of the workpiece 10. In such a state the templet 40 serves as a constraining member which restrains the workpiece 10 from irregularly straining.

After completion of the intended heating operation the jig unit supporting the workpiece 10 is taken out of the furnace and, together with the workpiece 10, is subjected to cooling in a predetermined manner such as, for example, quenching by immersion in a water tank. When the templet 40 is designed such that the cooling rate of the workpiece 10 becomes higher than that of the templet 40 the workpiece 10 remains in contact with or, rather, makes further intimate contact with the outer surface 42 of the templet 40 during the cooling process. Therefore, local strains in the workpiece 10, if any, are effectively remedied, and the workpiece 10 can retain its exact shape. After cooling the workpiece 10 is detached from the jig unit. The workpiece 10 can be separated from the templet 40 without difficulty because of the existence of the diffusion bonding inhibiter between the outer surface 42 of the templet 40 and the inner surface 12 of the workpiece 10.

The workpiece 10 heat-treated in this manner is subjected to very little thermal strain, and the inner surface 12 remains in a very good state since this surface does not contact with the atmosphere during the heating process.

Figure 3:
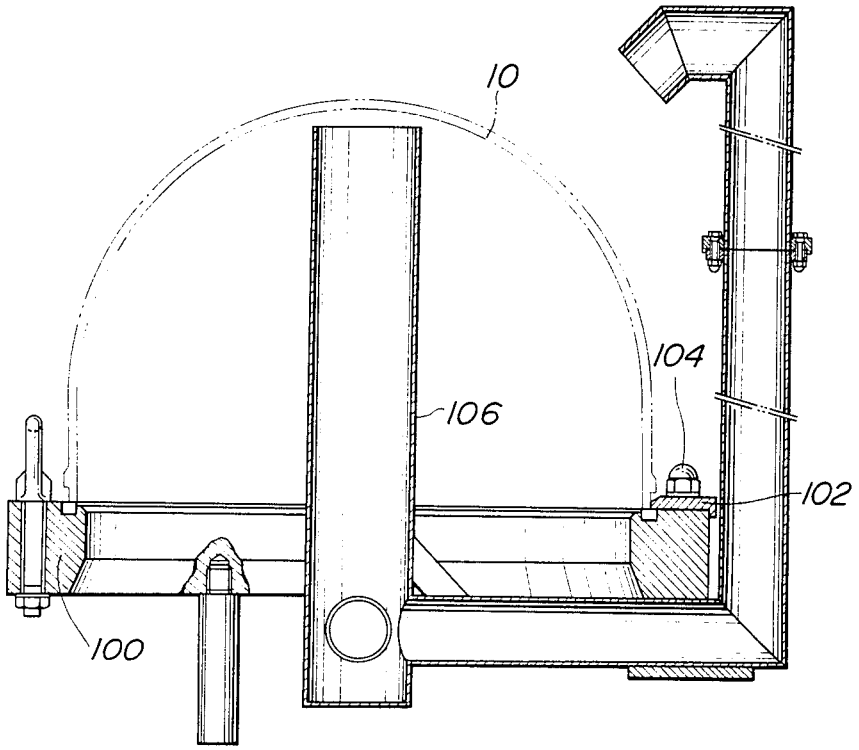
FIG. 3 (PRIOR ART)
FIG. 3 is a vertical sectional view of a known support unit for heat treatment of a similar workpieces.

For comparison, FIG. 3 shows a conventional support unit for heat treatment of the same workpiece 10. Essentially the support unit consists of an annular base 100 which is transferrable and to which the work 10 is fastened by using clamps 102 and bolts 104 and an exhaust duct 106. When this support unit is used the major region of the vessel-like workpiece 10 is left unconstrained during the heating and cooling operations. Not only the outer surface but also the inner surface of the workpiece 10 is exposed to the atmosphere during the heating operation. Therefore, it is impossible to obtain the important effects of the present invention by using the support unit of FIG. 3 though it has limited merits as described hereinbefore.

Figure 2:
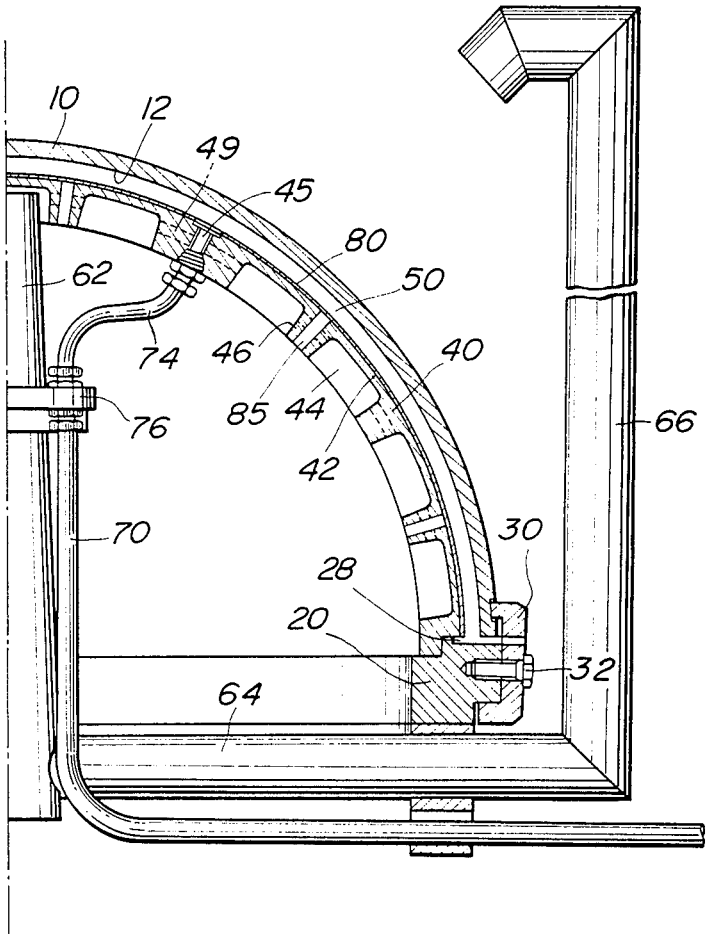
FIG. 2 is a partial and sectional view of another jig unit which is a minor and preferred modification of the jig unit of FIG. 1.

Referring to FIG. 2, it is preferred to closely cover the outer surface 42 of the templet 40 of the jig unit shown in FIG. 1 with a layer of a cooling promoting material 80 which is higher in heat conductivity than the material of the templet 40. For example, when the templet 40 is made of an austenite stainless steel, nickel is very suitable as the cooling promoting material 80 since the heat conductivity of nickel is about five times as high as that of austenite stainless steel. Of course this is not a limitation. Copper or any other highly heat conductive metal can alternatively be used. The cooling promoting material 80 comes into close contact with the inner surface 12 of the workpiece 10 during the heating operation and remains in that state when the heated workpiece 10 is cooled by, for example, immersion in water. Therefore, the cooling rate of the workpiece 10 is considerably enhanced. Besides, the templet 40 in FIG. 2 is formed with a plurality of through-holes 85 in some of the reinforcing rib-like projections 46 so that cooling water comes into contact with the back surface of the cooling promoting layer 80. This is effective for further enhancement of the cooling rate of the workpiece 10. By thus promoting the cooling of the workpiece 10 it is possible to further improve the effects of the heat treatment.

What is claimed is:

1. A method of heat treating a metal workpiece with a depression which provides a concave inner surface and an open end, said method comprising the steps of:

providing a jig unit which comprises a transferable support means and a constraining templet member which has an outer convex surface shaped correspondingly to the inner concave surface of the workpiece, and means securing said templet to said support means, the material of said templet member having an expansion coefficient greater than the expansion coefficient of the material of the workpiece;

securing the workpiece near the open end to said support means such that, prior to heat treatment, there is space between said outer surface of said templet member and the inner surface of the workpiece and when the workpiece and said templet member are heat treated, because the expansion coefficient of said templet is greater than that of the workpiece, said outer surface of said templet comes into contact with the inner surface of the workpiece;

heating the workpiece together with said jig unit at said predetermined temperature for a predetermined time while introducing an inactive gas into the space between the inner surface of the workpiece and said outer surface of said templet member, whereby said templet member comes into contact with the inner surface of the workpiece due to thermal expansion and said templet member constrains the workpiece;

cooling the heated workpiece to a predetermined temperature together with said templet member while said outer surface of said templet member is still in contact with the inner surface of the workpiece.

2. A method according to claim 1, holding the workpiece with the inner surface facing downward during the heating and cooling steps.

3. A method according to claim 2, wherein the cooling step comprises the substep of discharging gaseous substances from inside the workpiece.

4. A method according to claim 1 including during the cooling step, promoting cooling of the workpiece more rapidly than said templet member.

5. A method according to claim 1, further comprising the step of closely covering said outer surface of said templet member with a layer of a cooling promoting material which is higher in heat conductivity than the material of said templet member before the heating step.

6. A method according to claim 1, further comprising the step of applying a diffusion bonding inhibiter to said outer surface of said templet member before the heating step.

7. A method according to claim 6, wherein said diffusion bonding inhibiter is a ceramic powder.

* * * * *